US005685509A

United States Patent [19]

Harrison

[11] Patent Number: 5,685,509

[45] **Date of Patent: *Nov. 11, 1997**

[54] WATER HEATER STAND

[76] Inventor: Guy Wayne Harrison, 1709 Parklane, Edmond, Okla. 73034

[ * ] Notice: The term of this patent shall not extend beyond the expiration date of Pat. No. 5,386,263.

[21] Appl. No.: 559,441

[22] Filed: Nov. 15, 1995

[51] Int. Cl.[6] ..... A47G 23/02

[52] U.S. Cl. ..... 248/146; 248/154

[58] Field of Search ..... 248/146, 176.1, 248/346.01, 346.05, 154

[56] References Cited

U.S. PATENT DOCUMENTS

| | | | |
|---|---|---|---|
| 2,199,481 | 5/1940 | Chappell | 248/146 |
| 2,204,686 | 6/1940 | Litle | 248/146 |
| 2,784,577 | 3/1957 | Beaham, III | 248/146 |
| 3,272,466 | 9/1966 | Sherman | 298/146 |
| 4,267,998 | 5/1981 | Weirich | 248/165 |
| 4,555,837 | 12/1985 | Daugirda et al. | 29/432 |
| 4,858,872 | 8/1989 | Witt | 248/146 |
| 4,932,621 | 6/1990 | Kowk | 248/146 |
| 4,998,696 | 3/1991 | Desjardins | 248/176.1 |
| 5,199,676 | 4/1993 | Kowalewski | 248/149 |
| 5,368,263 | 11/1994 | Harrison | 248/146 |
| 5,390,887 | 2/1995 | Campbell | 248/146 |

FOREIGN PATENT DOCUMENTS 1120232 3/1982 Canada .

*Primary Examiner*—Leslie A. Braun
*Assistant Examiner*—Willie Berry, Jr.

[57] ABSTRACT

An appliance stand for supporting ignitable appliances of various sizes comprises a generally frustoconical base member of a predetermined height and width and a generally circular top support member having a peripheral edge, wherein the edge is connected to an edge of the base member, a generally frustoconical retention lip member of a predetermined height and diameter connected to an outer surface of the top support member and extends from the peripheral edge of the top support member in a common direction with the base member, wherein the top support member and retention lip member form a water retainer and the threaded aperture surface being formed in a recessed cup surface adjacent the retention lip and the support surface to provide an opening surface adapted to receive a drain pipe thereto.

17 Claims, 1 Drawing Sheet

WATER HEATER STAND

BACKGROUND OF THE INVENTION

This invention relates to an appliance stand, and more particularly, to an appliance stand having a drainage system therein for support of an ignitable appliance, such as a water heater.

An ignitable appliance, such as a water heater, is typically positioned within a limited space of a dwelling and on a floor adjacent the garage. For example, the water heater is placed in a closet with a central heating unit wherein the closet may or may not be built on a raised platform. Gasoline and other flammable liquids are commonly stored within the garage, and most commonly in cans on the garage floor. Not infrequently, these flammable liquids are spilled or leaked onto the garage floor and fumes emanating from these liquids tend to hover and travel low to the garage floor and into the area where the water heater is housed. There have been a number of accidents involving an ignitable appliance, such as a water heater, wherein a pilot light of the appliance is an instrument which ignites these fumes resulting in explosion and/or fire.

Additionally, a drain is normally formed in the floor of the closet which houses the water heater to catch leakage from the water heater. However, the location of the drain varies. Leaks can occur on a point of the water heater which directs water away from the drain creating a mess and defeating the purpose of the drain. Attempts have been made at providing a stand for a water heater. Such attempts have failed to provide uniformity to the industry safety standards for supporting the ignitable appliance, such as a water heater, under dry or wet conditions. Such attempts also lack height adjustability, fail to provide for leakage, or are designed to inhibit maneuverability for assembly and positioning within small work areas. One type of stand described in U.S. Pat. No. 4,267,998 is directed to a wooden stand which requires on-site assembly. Such a stand lacks drainage directability, height adjustability and is susceptible to weakening from moisture.

Another type of stand disclosed in U.S. Pat. No. 5,199,676 is directed to a sheet-like metal stand which requires assembly at the site. Similarly, this stand lacks drainage directability. There exists a need for a relatively inexpensive stand which can elevate the ignitable appliance, such as a water heater, and associated pilot light above the garage floor and/or air region of concern. There is also needed for an appliance stand in order to raise the ignitable appliance, such as a water heater, a desired height while allowing accommodation of the ignitable appliance, such as a water heater, within the housing environment. Still there is another need to have a stand which is easy to install within a limited work space wherein the ignitable appliance, such as a water heater, is housed. There is also a need for a stand to include a drainage system. Finally, there is a need to provide a safe stand for an ignitable appliance, such as a water heater, which solves the above needs and brings uniformity to the industry.

Accordingly, one stand which addresses these problems and solves the aforesaid problems is described in commonly owned U.S. Pat. No. 5,368,263. The present invention modifies and improves upon the invention described therein.

SUMMARY OF THE PRESENT INVENTION

It is an object of the present invention to provide a relatively inexpensive stand which includes a drainage system and is relatively easy to install.

It is an object of the present invention to provide an appliance stand which is relatively light weight and capable of sustaining relatively heavy ignitable appliance, such as a water heater, for extended periods of time under wet or dry conditions.

It is another object of the present invention to provide for an appliance stand which requires minimal or no assembly.

It is still another object of the present invention to provide for an appliance stand which is relatively safe.

It is yet another object of the present invention to provide for an appliance stand which is easily installed in limited a work area.

Accordingly, the invention is directed to a stand for raising an ignitable appliance, such as a water heater, above a support floor a distance which is above and beyond a region of air lying adjacent the floor which is susceptible to containing flammable fumes emanating from flammable liquids on the floor, which includes a base of a predetermined height to raise the ignitable appliance a sufficient distance above the region of air. The base has a support surface for supporting the ignitable appliance and a retention lip member extending from the support surface to retain leakage from the ignitable appliance. Adjacent the retention lip member and the support surface there is at least one preformed threaded aperture formed in a recessed cup surface which provides an opening to which a drain pipe can be threadedly connected thereto. The support surface is preferably arcuately shaped to aid drainage in this regard. In the preferred embodiment, the base is tapered from wide to narrow from the bottom to top of the stand, respectively.

One embodiment of the invention is directed to an appliance stand for supporting ignitable appliances of various sizes, comprising four generally trapezoidal side panels of a predetermined height and width, each panel having two ends, wherein each end of one of the panels connects to one end of another of the panels such that the side panels interconnect to form a substantially trapezoidal base. The stand has a generally rectangular top support panel having four edges, wherein each edge is connected to an edge of each side panel. The stand has four generally trapezoidal retention lip members of a predetermined height and width connected to an edge of the top support panel and extend substantially along a common plane with the side panel interconnecting thereto, the retention lip members having two ends, wherein each end of one of the retention lip members connects to one end of another of the retention lip members such that the retention lip members interconnect, wherein the top support member and retention lip members form a water retainer, at least one threaded aperture surface being formed in a recessed cup surface adjacent one of the retention lips and the support surface to provide an opening adapted to receive a drain pipe thereto. The top support panel is slightly dome shaped to aid drainage. The base is formed with a plurality of ribbed sections to lend strength to the base.

Another embodiment is directed to an appliance stand for supporting ignitable appliances of various sizes, comprising a generally frustoconical base member of a predetermined height and width and a generally circular top support member having a peripheral edge, wherein the edge is connected to an edge of the base member. The stand includes a generally frustoconical retention lip member of a predetermined height and diameter connected to an outer surface of the top support member and extends from the peripheral edge of the top support member in a common direction with the base member, wherein the top support member and retention lip member form a water retainer, the threaded aperture surface being formed in a recessed cup surface adjacent the retention lip and the support surface to provide an opening surface adapted to receive a drain pipe thereto. Preferably, the top support member is slightly dome shaped. The base if formed with a plurality of ribbed surfaces to lend strength thereto.

Other features and advantages of the invention will be apparent to those skilled in the art upon review of the following drawings, detailed description and claims appended hereto.

DETAILED DESCRIPTION OF THE PREFERRED EMBODIMENTS

Figure 1:
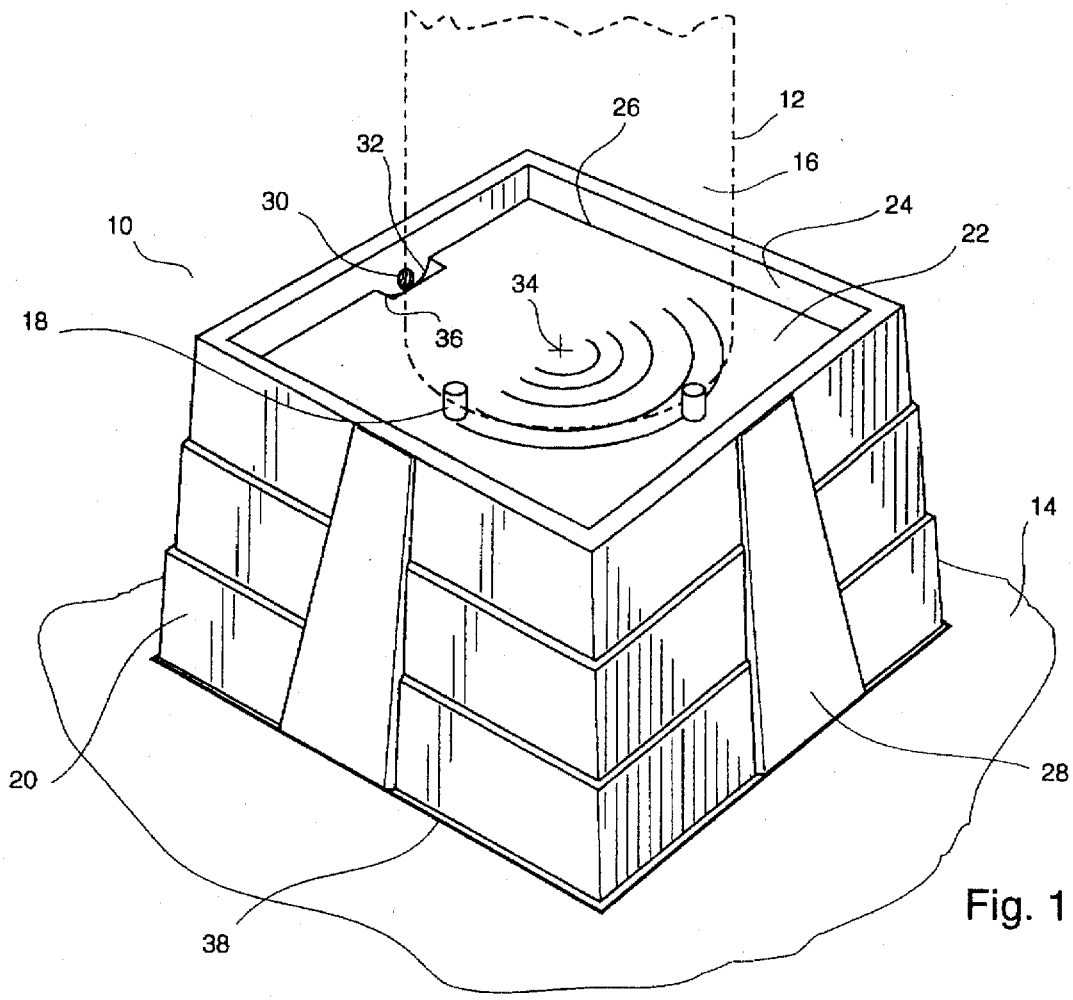
FIG. 1 is a perspective view of a stand in one embodiment of the present invention supporting an ignitable appliance.

Referring to FIG. 1, a stand 10 is shown as supporting a residential water heater appliance 12 above the support floor 14. The ignitable appliance 12 is of a typical size ranging between about 18–20 inches in diameter. The ignitable appliance 12 has a generally cylindrical tank housing 16 and optionally a base or support legs 18 which is typically an inch or two inch height.

The stand 10 is of a width to accommodate and support the ignitable appliance 12 with or without its legs 18. The stand 10 comprises side panels 20, support surface 22, and retention lip members 24. The panels 20, support surface 22 and retention lip members 24 are preferably integrally formed and are made of a plastic material such as polyethylene, cellulosics, polystyrene, acrylic polymers, fluorocarbon resins, nylon, phenolics, polyamides, and silicones, or engineering plastics for sustaining heavy loads, such as polycarbonates, ABS resins, polyvinyl chloride, PPO/styrene and polybutylene terephthalate.

Ingredients such as curatives, fillers, reinforcing agents, colorants and fire retardant agents known to the art may be included in the plastic material to achieve a desired set of properties. For example, to provide adequate support for the ignitable appliance, the side panels 20 and support surface 22 thicknesses will vary depending upon the type of plastic materials chosen. Preferably, it will be desirable to form the stand 10 of plastic material which is light weight, fire retardant and capable of sustaining loads in excess of 600 lbs.

Each retention lip members 24 preferably extends from the outer edges 26 of the support surface 22 in a plane common to its respective side panel 20 and in manner such that a tapered structure is formed wide to narrow from bottom to top, respectively. This allows for the stand 10 to be nested one on top of the other in a relatively stable fashion. The height of the retention lip members 24 is to be minimized so that the members 24 do not cause an interference when moving the ignitable appliance 12 for installation and removal thereof.

The side panels 20 are also formed with ribbed support surfaces 28 which are substantially equidistantly spaced from one another. The fibbed support surfaces 28 are of a size and configuration to avoid inhibiting the nesting function of the stands 10.

The retention lip members 24 have formed therein a preformed threaded aperture 30 in a recessed cup surface 32 adjacent the retention lip 24 and support surface 22. The prethreaded aperture 30 is formed such that a drain pipe can be readily attached and enable direction of leakage and connection to a floor drain.

Alternatively, the stand 10 is formed of a plastic material which allows the surface 30 to be self threading. Additionally, the pipe may be solvent welded about the surface 30. In this regard, the recessed cup surface 32 permits adequate access to attach and secure the pipe to the surface 30.

The support surface 22 is slightly arcuate or dome shaped to aid drainage to the recessed cup surface 32. However, the support surface 22 is of a minimal pitch to allow for quick and stable placement of the ignitable appliance 12 thereon. For example, a pitch of approximately one quarter inch from a center point 34 of the support surface 22 to the point 36 of the support surface 22 adjacent the recessed cup surface 32. Finally, a bottom portion of each side panel 20 includes an anchor lip 38 to permit anchoring of the stand 10 to the floor 14.

Figure 2:
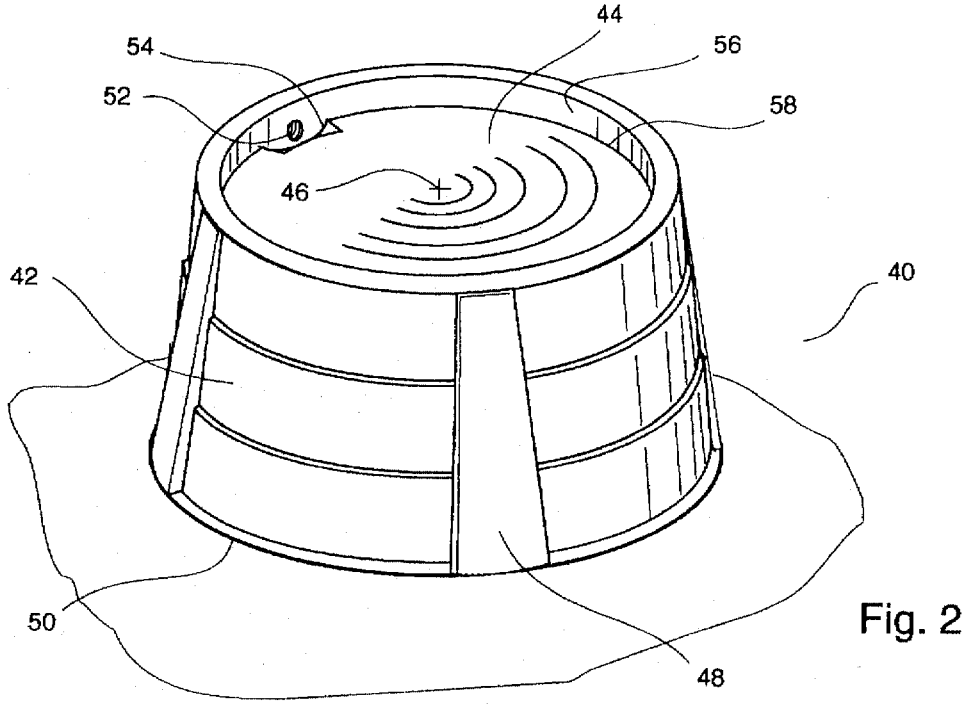
FIG. 2 is a perspective view of a stand in another embodiment of the present invention.

Referring to FIG. 2, stand 40 is shown. The stand 40 includes a generally frustoconical base panel 42, support surface 44 having a center point 46, ribbed support surface 48 and anchor lip 48. Also, included is a preformed threaded aperture 52 in a recessed cup surface 54 formed in a like manner to that described above. Similarly, a retention lip 56 extends from an edge 58 away from and along a common frustoconical space as the base panel 42. A bottom portion of the panel 42 includes an anchor lip 50 to permit anchoring of the stand 40 to the floor.

The stands are preferably integrally molded in one piece units. Thus, the above described embodiments provide for a stand which can be quickly and readily employed to raise the ignitable appliance to a safe and secure height. The embodiments also provide for an appliance stand which is not susceptible to deteriorating over time and is capable of sustaining ignitable appliances of various sizes in a relatively safe manner. The stand requires little or no assembly and minimal working area in which to install. The symmetrical design aids the ease of installation in that the stand can be set in place with minimal concern as to orientation, and the stand provides means for adapting a drain pipe to a desired side or circumferential location of the stand. Also, the improved design lends well to nesting, has increased strength, and readily permit anchoring to floors.

Various other embodiments and variations of the preferred embodiments will be apparent to those skilled in the art and may be made without departing from the spirit and scope of the invention as deemed by the following claims.

What is claimed is:

1. A stand for raising ignitable appliances of various sizes above a support floor a distance which is above and beyond a region of air lying adjacent the floor which is susceptible to containing flammable fumes emanating from flammable liquids on the floor, comprising.

a base of a predetermined height adapted to extend from the floor to a sufficient distance above the region of air and tapered such that said base is wider at a lower end adapted to be positioned on the floor and narrower at an upper end;

a support surface panel connected to said upper end of said base in a manner adapted to support the ignitable appliance above the region of air; and a retention lip member extending from said support surface to retain leakage from the ignitable appliance and having at least one open surface formed adjacent said support surface and said retention lip in a manner to which a drain pipe can be threadily connected thereto.

2. The stand of claim 1, which further includes a recessed cup surface formed adjacent said support surface and said retention lip and having said open surface formed therein.

3. The stand of claim 1, wherein said lower end of said base has an anchor lip formed thereon.

4. The stand of claim 1, wherein said support surface panel is slightly dome shaped.

5. The stand of claim 1, wherein said base includes a ribbed support surface.

6. The stand of claim 1, wherein said base includes four generally trapezoidal side panels of a predetermined height and width, each said side panel having two ends, wherein each end of one of said side panels connects to one end of another of said side panels such that said side panels interconnect so that said base is substantially trapezoidal, and wherein said support surface panel is characterized as generally and is connected to an edge of each said side panel, and wherein said retention lip member is characterized as including four generally trapezoidal lip portions of a predetermined height and width connected to said edges of said support surface panel and extend from said support surface panel, said retention lip members having two ends, wherein each end of one of said retention lip members connects to one end of another of said retention lip members such that said retention lip members interconnect.

7. An appliance stand for raising ignitable appliances of various sizes above a support floor a distance which is above and beyond a region of air lying adjacent the floor which is susceptible to containing flammable fumes emanating from flammable liquids on the floor, comprising:

a base of a predetermined height adapted to extend from the floor to a sufficient distance above the region of air wherein said base is generally frustoconical of a predetermined height and width;

a support surface panel connected to said base in a manner adapted to support the ignitable appliance above the region of air; and a frustoconical retention lip member extending from said support surface away from said base along a common frustoconical zone as said base 10 retain leakage from the ignitable appliance, wherein said support surface panel is generally circular having a peripheral edge, wherein said edge is connected to an edge of said base, and which further includes at least one open surface formed adjacent said support surface and said retention lip in a manner to which a drain pipe can be threadily connected thereto.

8. The stand of claim 7, which further includes a recessed cup surface formed adjacent said support surface and said retention lip and having said open surface formed therein.

9. The stand of claim 7, wherein said lower end of said base has an anchor lip formed thereon.

10. The stand of claim 7, wherein said support surface panel is slightly dome shaped.

11. The stand of claim 7, wherein said base includes a ribbed support surface.

12. A stand for raising an ignitable appliance which has support legs connected thereto above a support floor a distance which is above and beyond a region of air lying adjacent the floor which is susceptible to containing flammable fumes which emanate from flammable liquids when spilled on the floor, comprising:

a base of a predetermined height adapted to extend from the floor to a sufficient distance above said region of air having an upper end and a lower end;

a support surface panel connected to said upper end of said base in a manner adapted to support said ignitable appliance above said region of air wherein said support legs of said appliance are disposed on said support surface panel and said appliance is in a spaced relation to said support surface panel; and a retention lip member extending from said support surface panel to retain leakage from the ignitable appliance and having at least one open surface formed in one of said support surface panel and said retention lip to which a drain pipe can be connected thereto.

13. The stand of claim 12, wherein said lower end of said base includes an anchor lip to permit anchoring of said stand to the floor.

14. The stand of claim 12, wherein said appliance is a water heater.

15. A stand with an ignitable appliance disposed above a support floor a distance which is above and beyond a region of air lying adjacent the floor which is susceptible to containing flammable fumes which emanate from flammable liquids when spilled on the floor, comprising:

an ignitable appliance component having support legs connected thereto;

a base of a predetermined height adapted to extend from the floor to a sufficient distance above said region of air having an upper end and a lower end;

a support surface panel connected to said upper end of said base in a manner adapted to support said ignitable appliance component above said region of air wherein said support legs are disposed on said support surface panel and said ignitable appliance component is in a spaced relation to said support surface panel; and a retention lip member extending from said support surface panel to retain leakage from the ignitable appliance and having at least one open surface formed in one of the support surface panel and the retention lip to which a drain pipe can be connected thereto.

16. The stand with an ignitable appliance of claim 15, wherein said lower end of said base includes an anchor lip to permit anchoring of said stand to the floor.

17. The stand with an ignitable appliance of claim 15, wherein said ignitable appliance is a water heater.

* * * * *